US011731796B2

(12) United States Patent
Starcevic

(10) Patent No.: US 11,731,796 B2
(45) Date of Patent: Aug. 22, 2023

(54) DEVICE FOR, AND METHOD OF, APPLYING, DRYING AND ACTIVATING HOT GLUE ON A PACKAGING MACHINE

(71) Applicant: STAX TECHNOLOGIES DOO KONJEVICI, Čačak (RS)

(72) Inventor: Mladen Starcevic, Čačak (RS)

(73) Assignee: Stax Technologies DOO Konjevici, Cacak (RS)

( * ) Notice: Subject to any disclaimer, the term of this patent is extended or adjusted under 35 U.S.C. 154(b) by 93 days.

(21) Appl. No.: 17/433,286

(22) PCT Filed: May 28, 2020

(86) PCT No.: PCT/RS2020/000007

§ 371 (c)(1),
(2) Date: Aug. 24, 2021

(87) PCT Pub. No.: WO2020/204739

PCT Pub. Date: Oct. 8, 2020

(65) Prior Publication Data

US 2022/0185522 A1 Jun. 16, 2022

(30) Foreign Application Priority Data

Feb. 25, 2019 (RS) ..... P-2019/0255

(51) Int. Cl.
*B65B 51/02* (2006.01)
*B65B 11/06* (2006.01)
(Continued)

(52) U.S. Cl.
CPC ..... *B65B 51/02* (2013.01); *B65B 11/06* (2013.01); *B65B 25/145* (2013.01); *B65B 25/146* (2013.01); *B65B 51/10* (2013.01)

(58) Field of Classification Search
CPC ..... B65B 11/02; B65B 11/06; B65B 11/08; B65B 25/145; B65B 25/146; B65B 51/02;
(Continued)

(56) References Cited

U.S. PATENT DOCUMENTS 2,072,948 A * 3/1937 Geffs ..... B05B 13/02 118/316
2,659,341 A * 11/1953 Taggart ..... B65B 51/02 118/42

(Continued)

OTHER PUBLICATIONS

International Search Report for PCT/RS2020/000007 dated Dec. 8, 2020.

*Primary Examiner* — Stephen F. Gerrity
(74) *Attorney, Agent, or Firm* — Thompson Coburn LLP

(57) ABSTRACT

The invention relates to a device for, and method of, applying, drying and activating hot glue on the packaging machine itself. In the case of the basic option, the device works as follows: two assemblies (1) for applying and drying glue are positioned on the plates (3) of machine (M). Assemblies (1) are made up of consoles (11) mounted in a way that enables them to slide and move, their front end on the lever (32) and their rear end on the shaft (31) attached between two plates (3). The lever (32) is attached, by way of levers (33), between the plates (3). One device (12) for applying hot glue is attached to the consoles (11), just above the lever (32), while a number of fans (13) are fastened along the console (11), above the device (12), as well as on the opposite side. The heater (4) is horizontally attached to the carrier (42) and positioned in the opening (43) on the plate (41). The strip heater (7) is made up of an endless strip (71) and vertical heaters (72). In the case of the basic option, the method of applying, drying and activating hot glue on the packaging machine itself consists of the following: paper (5) from the roll (51) is introduced under the consoles (11). The
(Continued)

devices (12) apply hot glue to the top side of the paper in a continuous strip (61) and a discontinuous strip (62). Strips of glue (61, 62) are dried by fans (13) and further transported through the machine (M), together with the paper (5). Once the product is packaged, packages reach a horizontal heater (4) which activates the glue (61, 62) on the bottom side of the package, after which product packages pass between vertical heaters (72) which activate the glue on the sides of packages.

15 Claims, 12 Drawing Sheets

(51) Int. Cl.
*B65B 25/14* (2006.01)
*B65B 51/10* (2006.01)

(58) Field of Classification Search
CPC ..... B65B 51/023; B65B 51/10; B05C 5/025; B05C 5/0287
USPC ..... 53/370.3, 373.3; 118/314, 316
See application file for complete search history.

(56) References Cited

U.S. PATENT DOCUMENTS

| | | | | |
|---|---|---|---|---|
| 2,984,598 | A * | 5/1961 | Gobalet | B65B 51/02 156/320 |
| 3,348,519 | A * | 10/1967 | Dyess, Jr. et al. | B65B 51/02 118/684 |
| 3,750,361 | A * | 8/1973 | Stevens | B65B 11/12 53/141 |
| 4,894,104 | A * | 1/1990 | Hemus | B65B 51/023 156/499 |
| 5,575,135 | A | 11/1996 | Nordstrom | |
| 5,656,084 | A | 8/1997 | Focke et al. | |
| 5,931,292 | A | 8/1999 | Focke et al. | |
| 5,985,360 | A | 11/1999 | Boriani et al. | |
| 6,341,474 | B1 | 1/2002 | Focke et al. | |
| 6,586,050 | B1 | 7/2003 | Fort | |
| 7,563,326 | B2 * | 7/2009 | Tietz et al. | D21H 23/48 118/316 |
| 2006/0207224 | A1 * | 9/2006 | Ghini et al. | B65B 51/02 53/228 |
| 2007/0131739 | A1 * | 6/2007 | Ponti | B65B 51/023 229/87.01 |
| 2013/0213834 | A1 | 8/2013 | Koster et al. | |

* cited by examiner

DEVICE FOR, AND METHOD OF, APPLYING, DRYING AND ACTIVATING HOT GLUE ON A PACKAGING MACHINE

CROSS-REFERENCE TO RELATED APPLICATIONS

This application is a U.S. National Phase application of PCT/RS2020/000007, filed on May 28, 2020, which claims the benefit of Serbian Application No. P-2019/0255, filed Feb. 25, 2019, both of which are incorporated herein by reference in their entirety.

TECHNICAL FIELD

The invention belongs to the field of mechanical engineering, i.e. machines for automatic packaging of products in PVC or paper packaging, or more precisely to the types of devices and procedures that are used for applying, drying and activating glue on the paper wrapper of products on the packaging machine itself.

According to the International Patent Classification (IPC), the invention is classified as belonging to class B65G 47/00 (2006.01), which serves to define article or material-handling devices associated with conveyers; methods employing such devices. The invention is even more precisely classified as belonging to class B65B 51/02 (2006.01), which defines devices for, or methods of, sealing or securing package folds or closures, e.g. twisted bag necks, by applying adhesives or sealing liquids. The invention may also be classified as belonging to class B65B 51/10 (2006.01), which defines devices for, or methods of, sealing or securing package folds or packages, e.g. twisted bag necks, by applying or generating heat or pressure or combinations thereof.

TECHNICAL PROBLEM

The technical problem solved by the invention at hand is how to constructively create a solution for a device for, and method of, applying, drying and activating hot glue on the packaging machine itself, in order to enable—using devices for continuous and/or discontinuous application of hot glue on paper, devices for drying the glue which are placed on the same console at the front end of the machine, and devices for activating the glue by heat and pressure located at the end of the machine, devices which are all electronically connected, by way of a controller, to the machine's CPU—efficient packaging of napkins, toilet paper rolls or other material in PVC or paper packaging using the same machine, without any prior changes or adjustments made to the machine, while applying the glue only in the glue application area, for reasons of economy and the glue's instant drying, to prevent contamination of the machine during the transport of paper tape.

PRIOR ART

The applicants are aware of the solutions of the following manufacturers. Napkin and facial tissue packaging is quite common. Machines already on the market deal exclusively with the packaging of napkins in heat-sealable PVC foil sealed on all sides (full wrap). Companies that produce this type of equipment are Multipack s.r.l. from Italy, Christian Senning Verpackungsmaschinen GmbH Co. KG, etc.

Certain manufacturers are also able, with some modifications, to package facial tissues using the same machine, which is not uncommon. As regards facial tissues, there are machines on the market that can wrap facial tissues in foil or paper (by bending—folding the packaging material around the product on four sides). The disadvantage of these machines is that when they work with paper, just before bending, hot glue must be applied to the paper in a liquid state, and the paper must then be overlapped so that it adheres all around the product. A company that manufactures this type of equipment is: Bretting from the United States (C. G. Bretting Manufacturing Co. Inc.

However, there are no machines that can package facial tissues by applying both full wrapping and bending using the same machine without prior adjustment of the machine's design.

The main disadvantage of the aforementioned machines is reflected in the fact that it is not possible to unite all packaging combinations in one machine by swiftly making changes to it. So far, no manufacturer has attempted to construct a single machine which would be able to package goods in either foil or paper, using both full wrapping and bending of facial tissues.

Disadvantages of the aforementioned solutions lie in the use of heat-sealable paper (where glue is placed on the entire surface of the paper), which significantly affects the high price of raw materials. In addition, few companies are able to make heat-sealable paper and are limited by the width of the paper, which renders this solution quite expensive. One of the possible solutions involves the application of hot glue in the paper bending areas; however, well known manufacturers, as well as the applicant, have abandoned this idea for technical and technological reasons.

EMBODIMENT OF THE INVENTION

The technical problem has been successfully solved by the device for, and method of, applying, drying and activating hot glue within the packaging machine itself, which is the subject of the invention at hand. According to the proposed solution, the device for applying, drying and activating hot glue is installed in the existing foil packaging machine, which allows for facial tissues or toilet paper rolls to be packaged in paper by way of both full wrapping and bending, without any technical adjustments. The device consists of a table used for applying and drying glue, which is placed at the mouth of the machine, and a heater for activating the dried glue, depending on the package, in the horizontal and vertical direction of the packaged product. At the mouth of the machine there are consoles which are used to pass the paper through the component for applying and drying the glue. The consoles are in the shape of the Latin letter "U" and in the lower section, mouth of the console, where paper enters, there is a device for continuous/discontinuous application of hot glue. In the case of the basic option, the glue-applying device applies glue only on one (top) side of the paper. A number of fans for drying the hot glue are positioned in the upper and rear part of the console, and are positioned on the same side of the paper to which the glue has been applied. The device for applying the glue applies it on both (top and bottom) sides of the paper, continuously or discontinuously as the need may be. A heater for contact activation of glue on the package containing the packaged product is placed in the middle part of the machine, in the opening of the horizontal plate. At the outlet part of the machine, two vertical strip heaters are mounted in parallel, for the purpose of vertical-double-sided activation of glue on the packaged product.

The advantages of this invention's technical solution are reflected in the fact that the device for, and method of, applying, drying and activating hot glue on the packaging machine itself make it possible to package facial tissues and toilet paper rolls in plastic foil or paper, using both full wrap and bending, without any technical adjustments. The advantages of this solution are certainly: the application of glue on paper only in areas where that is really necessary (economic reasons), its drying on site to prevent contamination of the machine and the glue's reactivation due to thermal treatment at the time when such treatment is necessary, on one machine and without any technical adjustments, regardless of whether the process involves paper or plastic foil.

A BRIEF DESCRIPTION OF THE DRAWINGS

The invention is explained in detail with the aid of the following accompanying drawings.

DETAILED DESCRIPTION OF THE INVENTION

Figure 1:
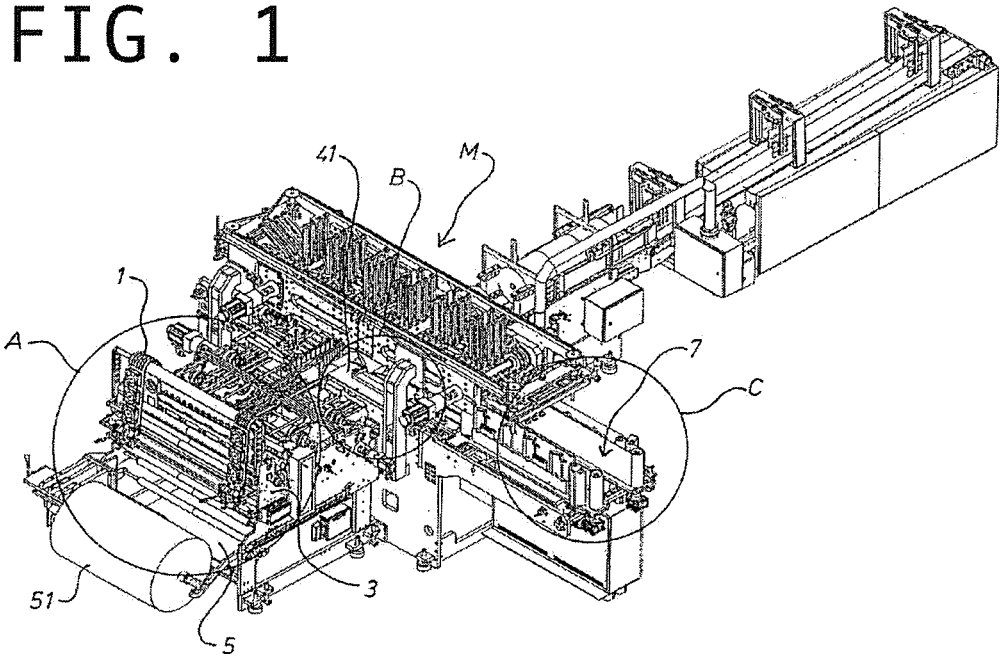
FIG. 1 shows the axonometric appearance of the packaging machine with the device for applying, drying and activating hot glue.
Figure 2:
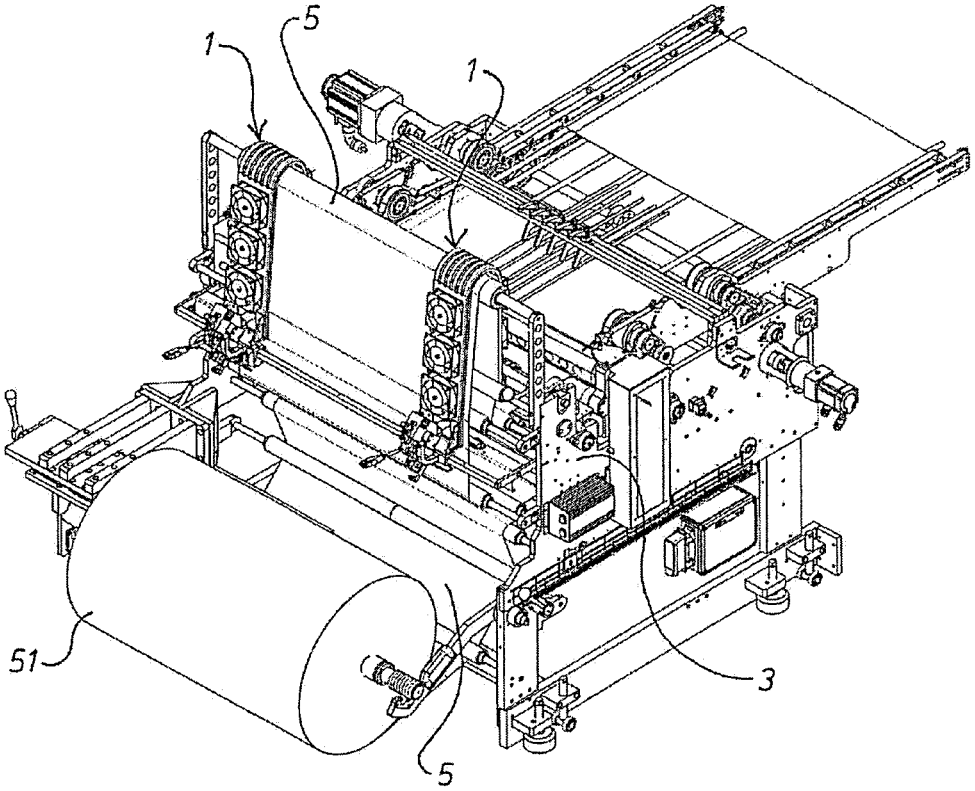
FIG. 2 shows detail "A" from FIG. 1.
Figure 3:
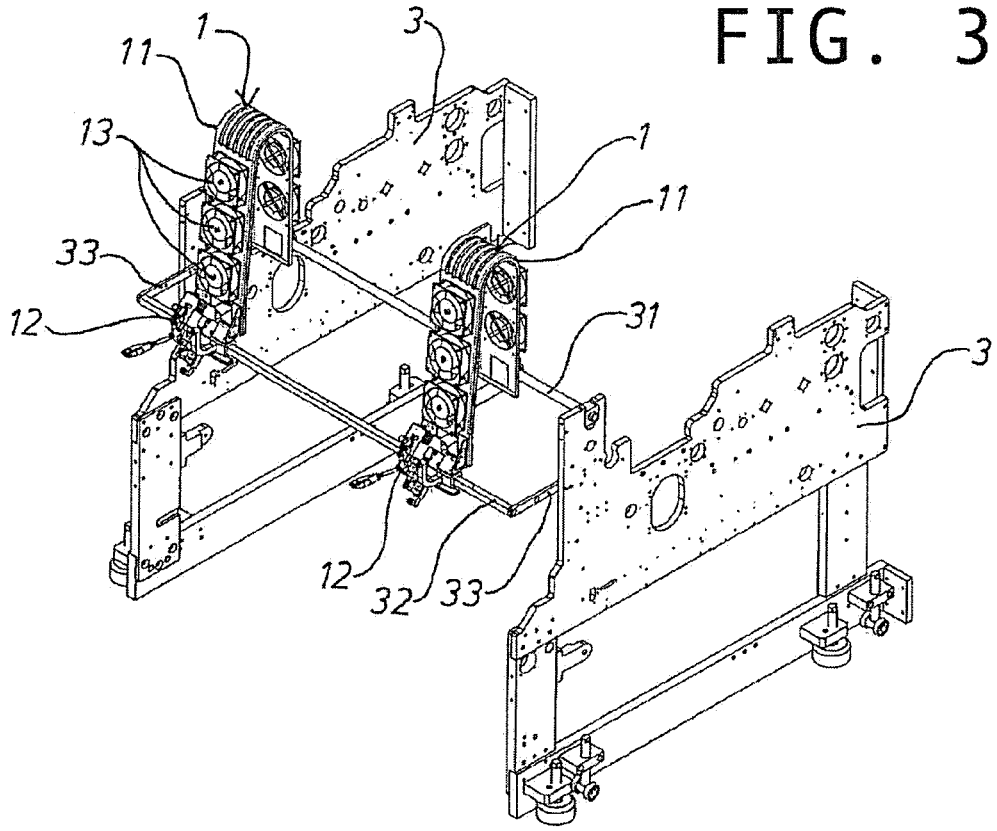
FIG. 3 shows details of the connection of the device for applying and drying glue from FIG. 1, the basic option.

In the case of the Basic Option of the present invention, the device for, and method of, applying, drying and activating hot glue on the packaging machine itself are implemented by placing two assemblies 1 for applying glue on plates 3 at the mouth of the packaging machine M, where packaging paper 5 is introduced into it (FIGS. 1, 2). Assemblies 1 are made up of holders 11, in the shape of the Latin letter "U", which are mounted in a way that enable them to slide—front end on a second linear guide 32, and rear end on shaft 31. Shaft 31 is attached between two plates 3. The second linear guide 32 is attached, via connection plates 33, between the plates 3. Plates 3 are standard, are known from the Prior Art, and are used to fasten other elements to the mouth of the machine, e.g. rollers for guiding paper 5, which unwinds from roll 51. On the holders 11, one device 12 for applying hot glue is attached just above the second linear guide 32. A number of fans 13 for drying the glue (FIG. 3) are attached along holder 11, above device 12 and on the opposite side. According to the present invention, the device also comprises heater 4, which is horizontally attached to the support 42 and placed in the opening 43 on plate 41. This heater contact-activates the dried glue on the underside of the package of products. This construction of plate 41 and heater 4 is known from the Prior Art and is used for welding packages in foil; however, within the scope of the present invention it is applied for the first time also for packaging goods in paper. According to the present invention, the device also comprises a vertical strip heater 7, made up of the endless strip 71 and vertical heaters 72. Its function consists in thermally activating the dried glue on the vertical sides of the product package. This construction of the vertical strip heater 7 is also known from the Prior Art, and is used for welding packages in foil; however, within the scope of the present invention it is applied for the first time also for packaging goods in paper. According to the present invention, the control part of machine M is designed as follows: heaters 4, 72 are connected to the controller 82 by connections 821. Fans 13 and glue applicators 12 are interconnected by connections 834 also with their controller 84. Controller 84 is connected to controller 83 via connections 831, 832. Controller 82 is connected, via connection 811, with subprocessor 81, with which controller 83 is also connected via connection 813. According to the present invention, subprocessor 81 is an integral part of processor 8 of machine M. Subprocessor 81, in correlation with controllers 82, 83, can independently guide and control the process, but must be correlated and controlled by processor 8, because the operation of the entire machine M is complex and requires coordination of a large number of individual operations.

Figure 5:
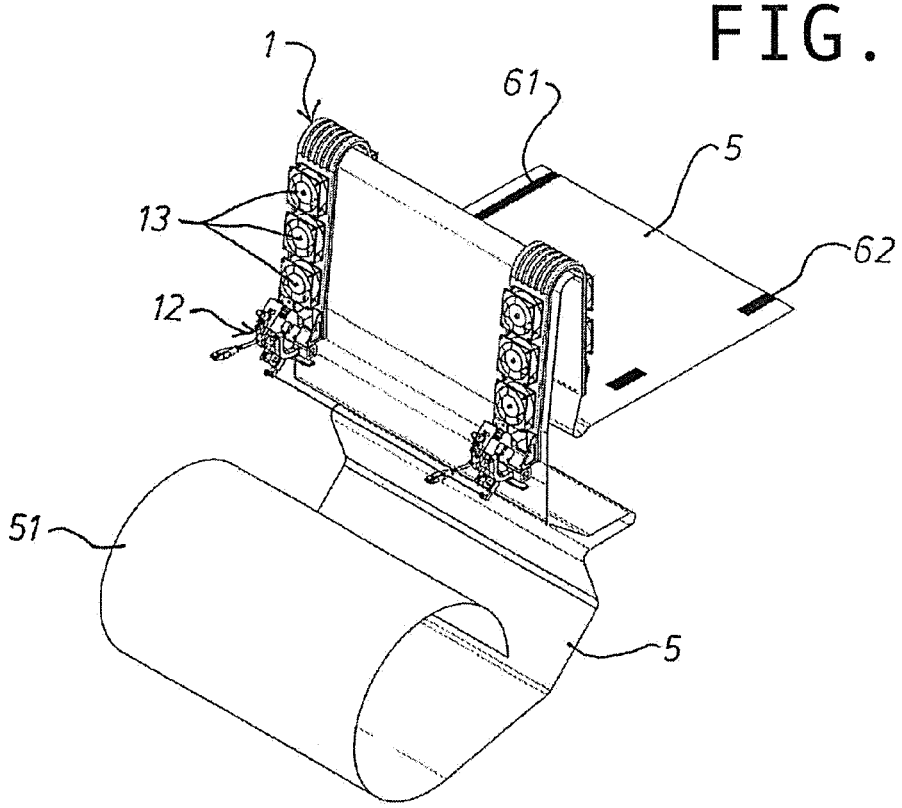
FIG. 5 shows the flow of paper and the applied glue, from the device shown in FIG. 3.

In the case of the basic option, the method of applying, drying and activating the hot glue on the packaging machine is performed by introducing the paper 5 from roll 51 using a standard system of rollers (not the subject of the invention) under holder 11 (FIG. 5). Devices 12 apply hot glue to the top side of the paper in a continuous strip 61, or in a discontinuous strip 62. Strips of glue 61, 62 are dried by fans 13 and further transported, together with paper 5, through machine M as dry glue. Once the product is packaged (not the subject of the invention), the packages reach the horizontal heater 4 which activates the glue 61, 62 on the underside of the package. Product packages then pass between the vertical heaters 72, which activate the glue on the sides of the packages, thus completing the packaging process.

Figure 4:
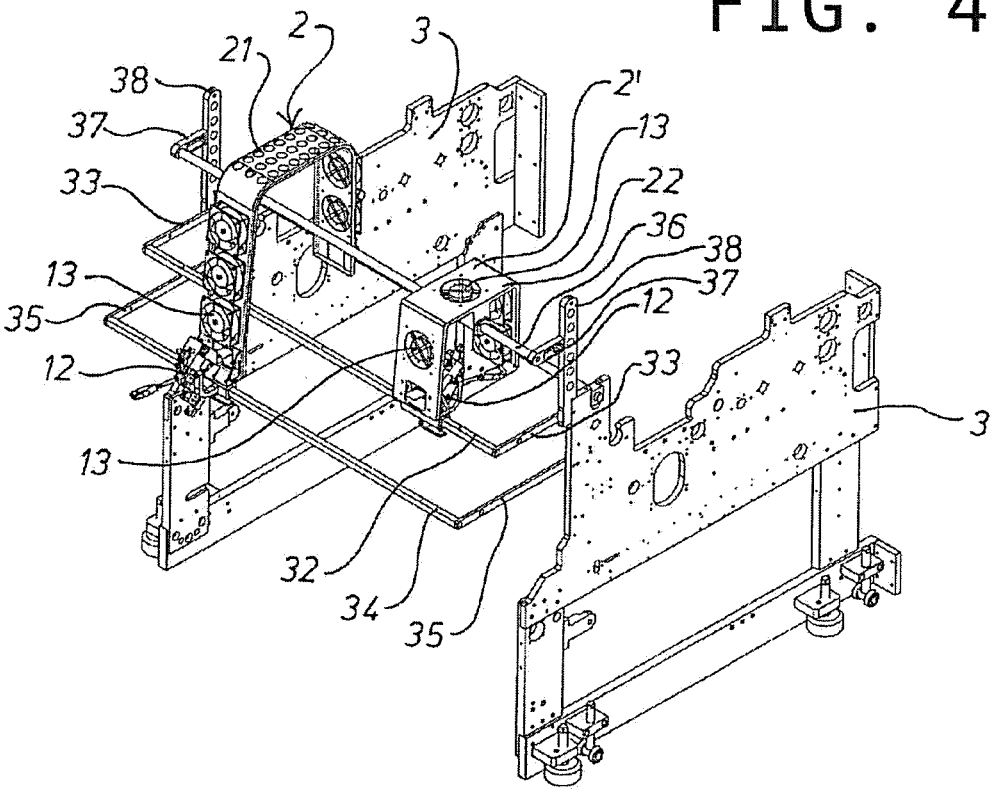
FIG. 4 shows the details of the connection of the device for applying and drying glue, from FIG. 1, Option 1.

In the case of Option 1 of the present invention, the device for, and the method of, applying, drying and activating hot glue on the packaging machine itself are implemented in the following manner: at the mouth of the machine M, where packaging paper 5 is introduced, assemblies 2, 2' for applying and drying glue are placed on plates 3 (FIG. 4). Assemblies 2, 2' are made up of holders 21 22, in the shape of the Cyrillic letter "P" ["1⁻1" ]. Holder 21 is slidably mounted on shaft 36, which is attached to plate 3 using connection plates 37, 38. On the other, bottom end, holder 21 is slidably mounted on a first linear guide 34 which is, using connection plate 35, attached to plate 3. Device 12 for applying hot glue is attached on holder 21, immediately above the first linear guide 34, while a number of fans 13 for drying the glue are attached along holder 21, above device 12, on the opposite side (FIG. 4). Holder 22 is slidably mounted on shaft 36, while on the other end it is slidably mounted on the second linear guide 32, which is attached to plate 3 via connection plates 33. Device 12 for applying hot glue is positioned on holder 22, on the inner side, just above lever 32, while a number of fans 13 are placed above it, along holder 22. In the case of this option, heaters 4, 72 are positioned the same way as in the basic option, and are performing the same function. The control part is also implemented the same way as in the basic option.

Figure 6:
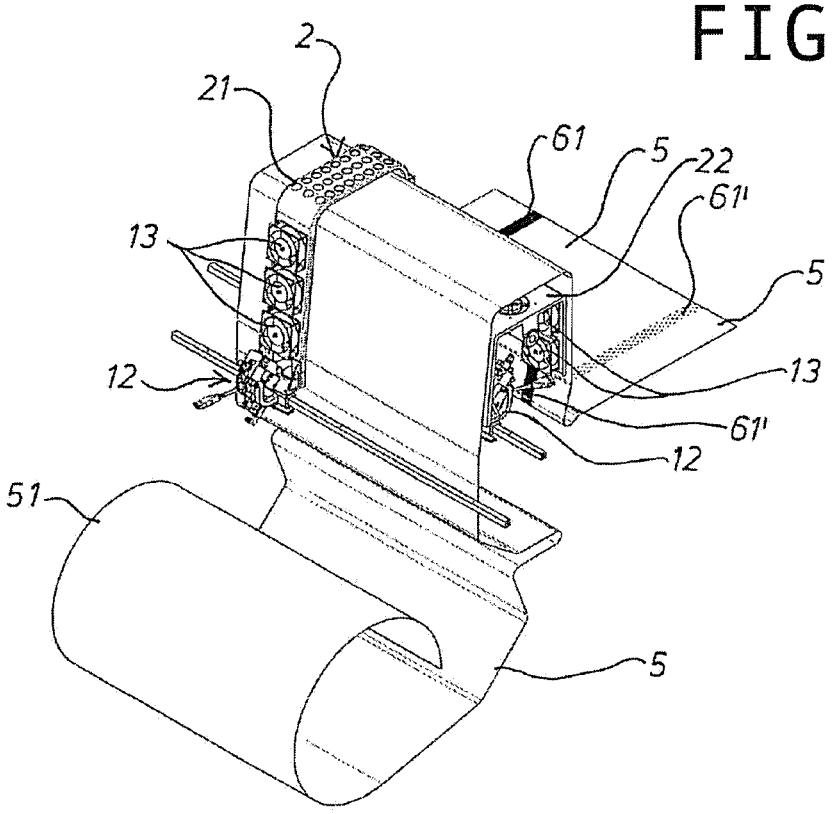
FIG. 6 shows the flow of paper and the applied glue, from the device shown in FIG. 4.
Figure 7:
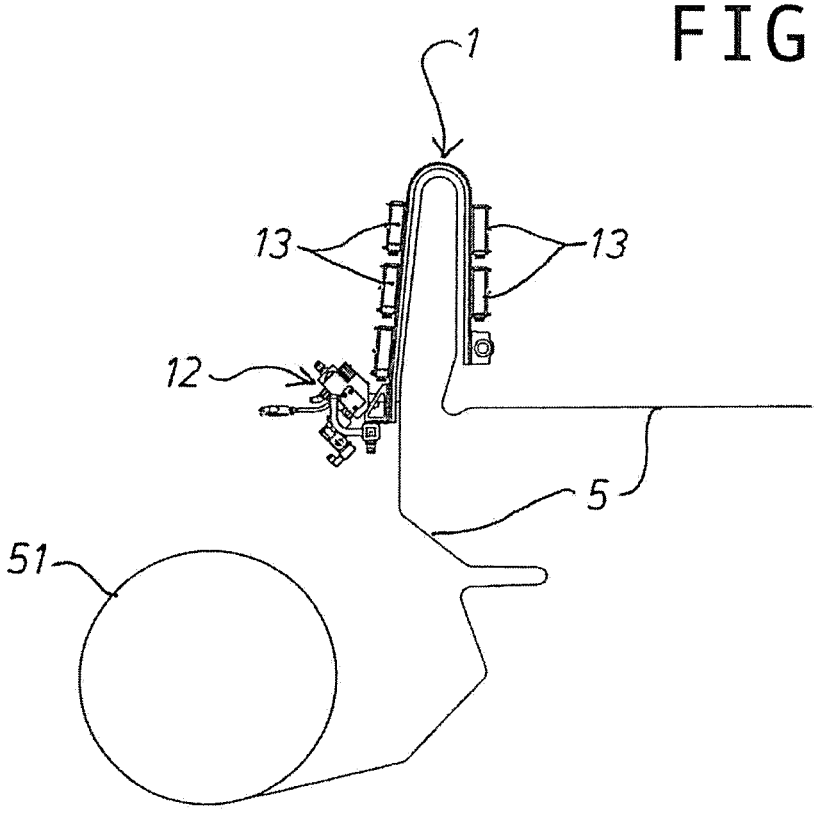
FIG. 7 shows the cross section of the device, basic option.
Figure 8:
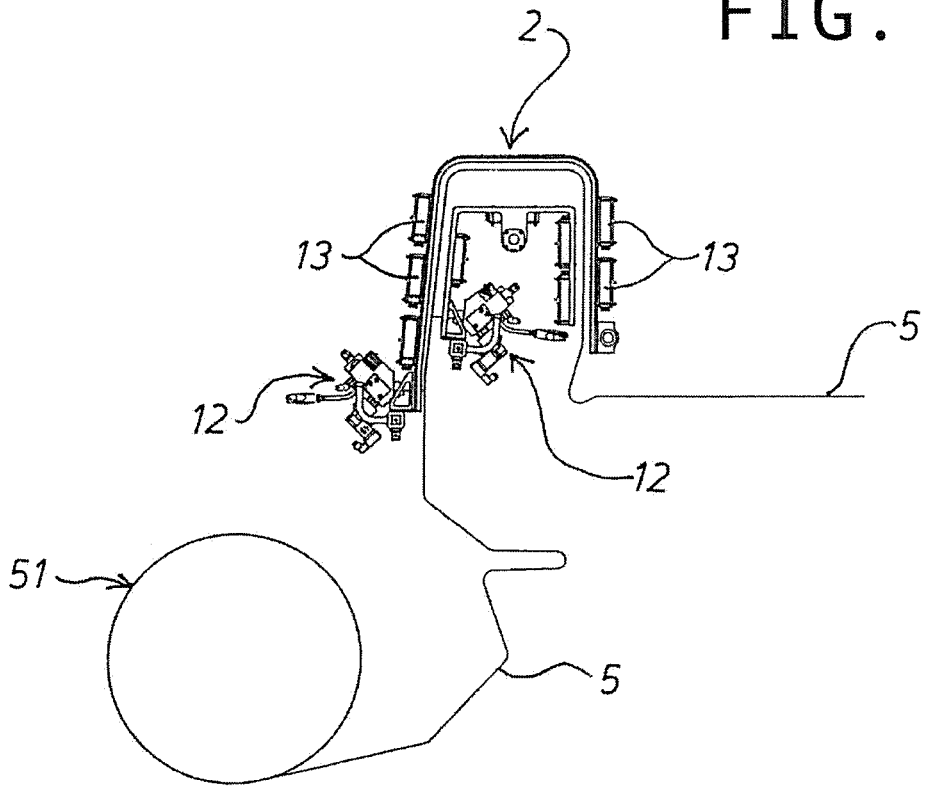
FIG. 8 shows the cross section of the device, Option 1.
Figure 9:
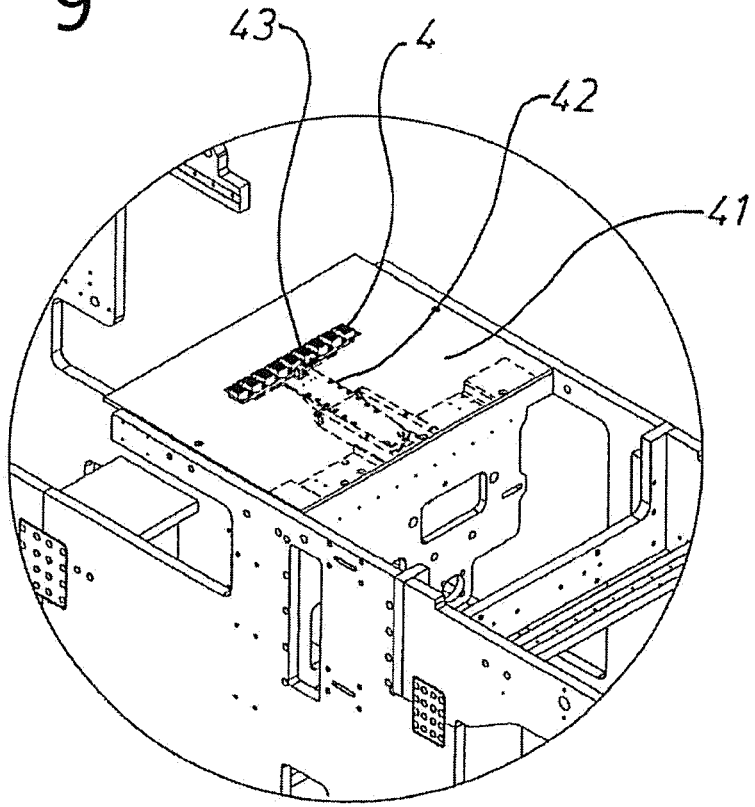
FIG. 9 shows detail area "B" from FIG. 1.
Figure 10:
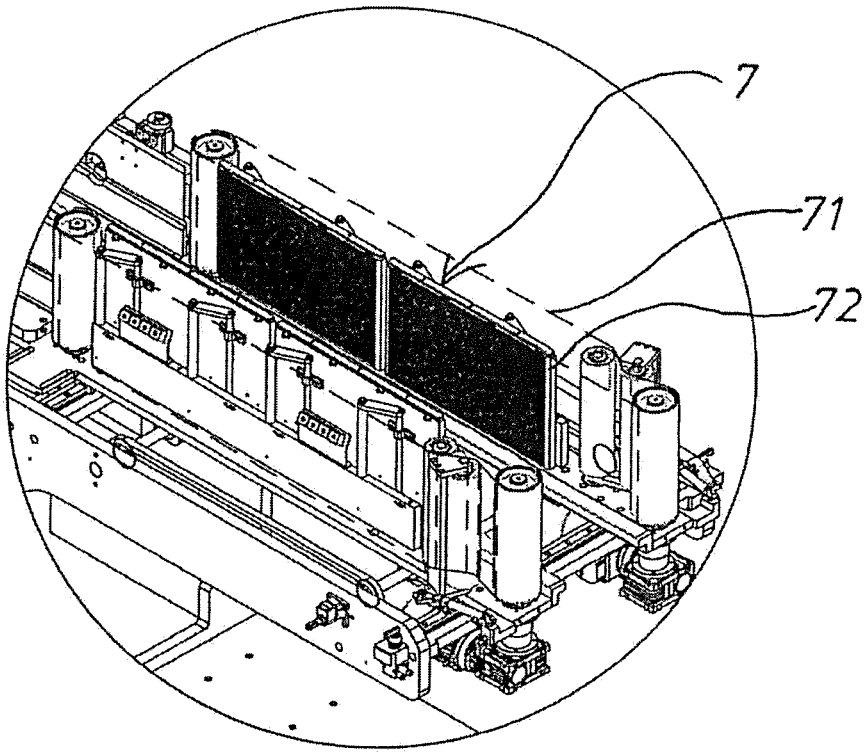
FIG. 10 shows detail area "C" from FIG. 1.
Figure 11:
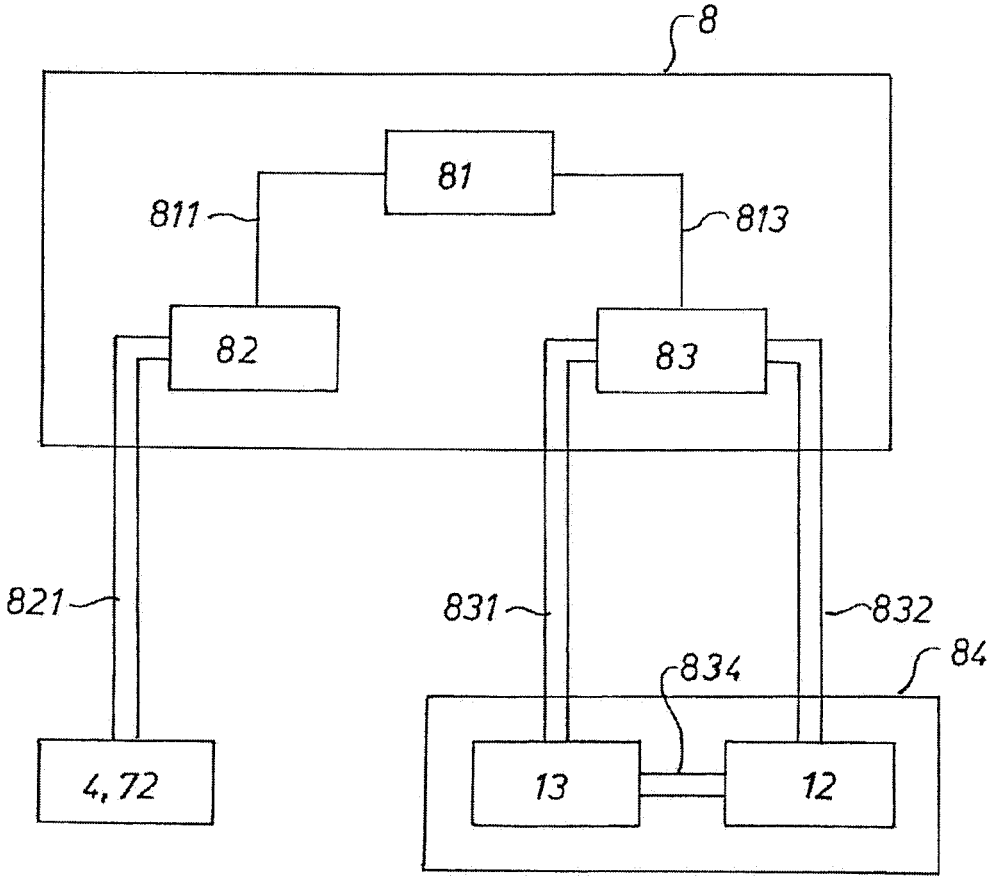
FIG. 11 shows a block diagram of the device automation, according to the patent, and FIG. 12 schematically shows the activation of glue with the help of the heater.
Figure 12:
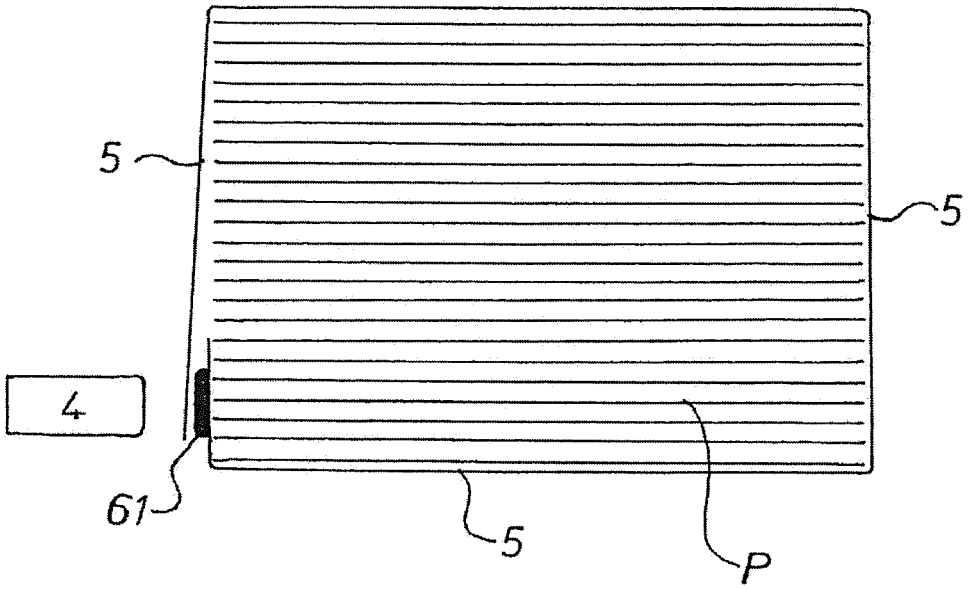

In Option 1, the method of applying, drying and activating hot glue on the packaging machine itself is implemented by introducing paper 5 from roll 51 using a standard system of rollers (not the subject of the invention) below holder 21 and above holder 22. The device applies hot glue to the top side of paper 5 from holder 21 in a continuous strip 61, while device 12 applies glue to the bottom side of paper 5 in a continuous/discontinuous strip 61 from holder 22 (FIG. 6). Strips of glue 61, 61' are dried by fans 13 and are transported, together with paper 5, as dry glue, through machine M. Once the product is packaged (not the subject of the invention), the packages reach horizontal heater 4 which activates glue 61, 62 on the underside of the packages. Thereupon, product packages pass between the vertical heaters 72, which activate the glue on the sides of the packages, thus completing the packaging process.

The advantage of the above described solution is reflected in the fact that it is possible to unify all the packaging combinations in one machine, with only a short time required for changing the operating mode. So far, none of the manufacturers has attempted to construct a single machine that would be able to perform packaging in foil or paper by way of full wrapping or bending. It is especially important that this invention makes is possible to package facial tissues or rolls of toilet paper in foil or paper using the same machine, without any special technical interventions.

INDUSTRIAL OR OTHER APPLICATION OF THE INVENTION

Using the invention at hand, the device for, and method of, applying, drying and activating hot glue on the packaging machine itself are implemented on standard machines for packaging products in foil, which are not able to package product in paper without special changes made to them. These changes require several hours of preparation and technical adjustment, which brings with it work delays. Also, the existing machines require the use of special paper with a full surface coating of glue, which is uneconomical, or the application of hot glue immediately prior to packaging, making the machine very dirty. In any case, existing machines require either significant modifications of a technical nature or the purchase of special machines only for the foregoing purpose.

Using the invention at hand, the device for, and method of, applying, drying and activating hot glue on a packaging machine is a machine that is universal for all necessary operations, in which changes to the operating mode are made by software adjustment and feeding of the appropriate material, i.e. paper or foil.

The invention claimed is:

1. A device for applying, drying, and activating hot glue on a packaging machine, characterized by:

opposing plates (3) defining a structure of the packaging machine (M);

a shaft (36) extending between and operatively connected to the plates (3) of the machine (M);

a first linear guide (34) and a second linear guide (32) extending between and operatively connected to the plates (3) of the machine (M), the second linear (32) guide being disposed between the shaft (36) and the first linear guide (34);

a first assembly and a second assembly (1,2,2') each adapted and configured for applying and drying the glue applied to a web (5) passing between the plates (3) of the machine (M), the first and second assemblies (1,2,2') being positioned between the plates (3) of the machine (M), each of the first and second assemblies (1,2,2') comprising a holder (11,21,22), the holder (11,21,22) of each assembly (1,2,2') having a front end and an opposite back end, the back end of the holder of each assembly being slidably mounted on the shaft (36), the front end of the holder of each assembly being selectively mountable relative to the first and second linear guides (32,34), wherein in a first configuration of the device, the front end of the holder (11) of the first assembly (1) is removably attached and slidably mounted to the first linear guide (34) and the front end of the holder (11) of the second assembly (1) is removably attached and slidably mounted to the first linear guide (34), and wherein a second configuration of the device, the front end of the holder (21) of the first assembly (2) is removably attached and slidably mounted to the first linear guide (34) and the front end of the holder (22) of the second assembly (2') is removably attached and slidably mounted to the second linear guide (32), each holder having at least one device (12) adapted and configured for applying hot glue to the web material (5) passing between the plates (3) of the machine (M), each holder (11,21,22) having at least one fan (13) arranged along the holder (11,21,22) in a direction of travel of the web material (5) passing through the machine, the at least one fan (13) of each holder being adapted and configured to direct air onto the web material (5) after application of the hot glue from the at least one glue application device (12) to dry the glue; and at least one heater (4,7,72) adapted and configured to activate the glue applied to the web by the least one glue application device.

2. The device according to claim 1, wherein the shaft (36) is attached to the plates (3) via respective connection plates (37, 38); the first linear guide (34) is attached to the plates (3) via respective connection plates (35); and the second linear guide (32) is attached to the plates (3) via respective connection plates (33).

3. The device according to claim 1, wherein the at least one heater (4,7,72) is connected to a heater controller (82) by use of connections (821); the at least one fan (13) and the at least one glue application device (12) are interconnected by connections (834) to each other through a fan and glue application controller (84), the at least one fan (13) and the at least one glue application device (12) are connected to a device controller (83), by connections (831, 832) the heater controller (82) and the device controller (83) are connected to a subprocessor (81) by way of respective connections (811,813), and the subprocessor is an integral part of a processor (8) of the machine (M).

4. The device according to claim 1, wherein the at least one glue application device (12) is adapted and configured to apply hot glue to the web material (5) passing through the machine in at least one of a continuous strip (61) and in a discontinuous strip (62).

5. The device according to claim 1, wherein, in the second configuration of the device, the at least one glue application device (12) of the holder (21) of the first assembly (2) is removably attached and slidably mounted to the first linear guide (34) is adapted and configured to apply hot glue to the web material (5) passing through the machine in a continuous strip (61); and the at least one glue application device (12) of the holder (22) of the second assembly (2') is adapted and configured to apply hot glue to an opposite side of the web material passing though the machine in at least one of a continuous (61) and a discontinuous strip (62).

6. The device according to claim 5 wherein the web material (5) passing through the machine (M) overwraps a product to form a package (P), and a first heater (4) of the at least one heater activates glue applied to the web on a bottom side of the package (P) and a second heater (7,71) of the at least one heater actives the glue applied to the web on at least one side of the package (P).

7. The device according to claim 1, wherein in the first configuration of the device, the holders (11) of each assembly (1) are positioned on a first side of the web material (5) passing through the machine (M), and wherein in the second configuration of the device, the holder (21) of the first assembly (2) is positioned on the first side of the web material (5) passing through the machine (M) and the holder (22) of the second assembly (2') is positioned on a second side of the web material (5) passing through the machine (M), the second side of the web material being opposite the first side of the web material.

8. The device according to claim 1, wherein in the first configuration of the device, the shaft (36) is spaced from the first linear guide (34) a first distance, and in the second configuration of the device, the shaft (36) is spaced from the first linear guide (34) a second distance, the second distance is greater than the first distance.

9. The device according to claim 1, wherein in the second configuration of the device, the shaft (36) is spaced from the first linear guide (34) a first distance, and the shaft (36) is spaced from the second linear guide (32) a second distance, the second distance is less than the first distance.

10. The device according to claim 1, each holder (11,21, 22) of the assemblies (1,2,2') has a surface that faces the web material (5), wherein in the first configuration of the device, the web facing surface of the holder (11) of each assembly (1) is oriented in the same direction toward the web material, and in the second configuration of the device, the web facing surface of the holder (21) of the first assembly (2) removably attached and slidably mounted to the first linear guide (34) is oriented to the web in a first orientation, and the web facing surface of the holder (22) of the second assembly (2') removably attached and slidably mounted to the second linear guide (32) is oriented to the web in a second orientation, the second orientation opposed to the first orientation with the web material therebetween.

11. A method of using a device for applying, drying and activating hot glue on a packaging machine, wherein the device has opposing plates (3) defining a structure of the packaging machine (M), a shaft (36) extending between and operatively connected to the plates (3) of the machine (M), a first linear guide (34) and a second linear guide (32) extending between and operatively connected to the plates (3) of the machine (M), the second linear (32) guide being disposed between the shaft (36) and the first linear guide (34), first and second assemblies (1,2,2') adapted and configured for applying and drying the glue applied to a web material (5) passing between the plates (3) of the machine (M), the first and second assemblies (1,2,2') being positioned between the plates (3) of the machine (M), each assembly (1,2,2') comprising a holder (11,21,22), the holder (11,21,22) of each assembly (1,2,2') having a front end and an opposite back end, the back end of the holder of each assembly being slidably mounted on the shaft (36), the front end of the holder of each assembly being selectively mountable relative to the first and second linear guides (32,34), the method comprising:

arranging the device in one of a first configuration and a second configuration based upon a location of glue to be applied to a web passing through the machine;

wherein the step of arranging the device in the first configuration includes removably attaching and slidably mounting the front end of the holder (11) of the first assembly (1) to the first linear guide (34) and removably attaching and slidably mounting the front end of the holder (11) of the second assembly (1) to the first linear guide (34) so that an at least one glue application device (12) arranged on each holder (11) applies hot glue to a same side of a web passing through the machine and at least one fan (13) on each holder (11) dries the glue applied to the web passing through the machine; and wherein the step of arranging the device in the second configuration includes removably attaching and slidably mounting the front end of the holders (21) of the first assembly (2) to the first linear guide (34) and removably attaching and slidably mounting the front end of the holder (21) of the second assembly (2') to the second linear guide (32) so that the at least one glue application device (12) arranged on the holder (21) of the first assembly (2) applies hot glue to one side of a web passing through the machine and at least one fan (13) on the holder (21) of the first assembly (2) dries the glue applied to the one side of the web material passing through the machine, and the at least one glue application device (12) arranged on the holder (22) of the second assembly (2') applies hot glue to an opposite side of the web passing through the machine and at least one fan (13) on the holder (11) of the second assembly (2') dries the glue applied to the opposite side of the web passing through the machine; and wherein in both the first and second configuration of the device, at least one heater (4,7,72) is adapted and configured to activate the glue applied to the web by the least one glue application device.

12. The method of claim 11 wherein in at least one of the first and second configuration of the device, the at least one glue application device (12) is adapted and configured to apply hot glue to the web material (5) passing through the machine in at least one of a continuous strip (61) and in a discontinuous strip (62).

13. The method of claim 12 wherein in the second configuration of the device, the at least one glue application device (12) of the holder (21) of the first assembly (2) removably attached and slidably mounted to the first linear guide (34) is adapted and configured to apply hot glue to the web (5) passing through the machine in a continuous strip (61); and the at least one glue application device (12) of the holder (22) of the second assembly (2') is adapted and configured to apply hot glue to an opposite side of the web passing though the machine in at least one of a continuous (61) and a discontinuous strip (62).

14. The method of claim 11 further comprising configuring the machine such that the web (5) passes through the machine (M) and overwraps a product to form a package (P), and a first heater (4) of the at least one heater activates glue applied to the web on a bottom side of the package (P) and a second heater (7,71) of the at least one heater actives the glue applied to the web on at least one side of the package (P).

15. The method of claim 11, wherein in the first configuration of the device, the holders (11) of each assembly (1) are positioned on a first side of the web (5) passing through the machine (M), and wherein in the second configuration of the device, the holder (21) of one assembly (2) is positioned on the first side of the web (5) passing through the machine (M) and the holder (22) of the other assembly (2') is positioned on a second side of the web (5) passing through the machine (M), the second side of the web being opposite the first side of the web.

* * * * *